US011898421B2

(12) United States Patent
Song et al.

(10) Patent No.: US 11,898,421 B2
(45) Date of Patent: Feb. 13, 2024

(54) SAND CONTROL DEVICE FOR MARINE HYDRATE PRODUCTION

(71) Applicant: Southwest Petroleum University, Sichuan (CN)

(72) Inventors: Jinze Song, Sichuan (CN); Shuxian Jiang, Sichuan (CN); Hongjun Zhu, Sichuan (CN); Shuai Liu, Sichuan (CN); Yue Gao, Sichuan (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 18/136,357

(22) Filed: Apr. 19, 2023

(65) Prior Publication Data

US 2023/0349268 A1 Nov. 2, 2023

(30) Foreign Application Priority Data

Apr. 27, 2022 (CN) ..... 202210457756.3

(51) Int. Cl.
*E21B 43/08* (2006.01)

(52) U.S. Cl.
CPC ..... *E21B 43/08* (2013.01)

(58) Field of Classification Search
None
See application file for complete search history.

(56) References Cited

U.S. PATENT DOCUMENTS 5,171,104 A * 12/1992 Bernhardt ..... B09C 1/08 405/128.15
2010/0224359 A1* 9/2010 Kim ..... E21B 43/088 166/231
2019/0017351 A1* 1/2019 Bowley ..... E21B 43/08

FOREIGN PATENT DOCUMENTS

CN 105756626 A * 7/2016
CN 105863590 A * 8/2016
CN 105927164 A * 9/2016
CN 105971567 A * 9/2016
CN 107780892 A * 3/2018
CN 107780893 A * 3/2018
CN 107780895 A * 3/2018
CN 111396001 A 7/2020
CN 112252999 A * 1/2021 ..... E21B 17/00
CN 112360404 A * 2/2021

(Continued)

*Primary Examiner* — Steven A MacDonald

(57) ABSTRACT

The present invention discloses a sand control device for marine hydrate production, which comprises a top motor, a bottom motor, and an inner-layer sand control cylinder, an outer-layer sand control cylinder and an outer-layer sand control screen coaxially arranged from inside to outside, wherein the top motor and bottom motor are configured to control the inner-layer sand control cylinder and the outer-layer sand control cylinder to rotate reversely, and wherein a plurality of sand retaining balls are provided between the inner-layer sand control cylinder and the outer-layer sand control cylinder and between the outer-layer sand control cylinder and the outer-layer sand control screen. According to the present invention, the arrangement of the inner-layer sand control cylinder and the outer-layer sand control cylinder rotating reversely can effectively prevent formation sand from accumulating on the surface of a sand control screen pipe and blocking the sand control screen pipe.

9 Claims, 2 Drawing Sheets

(56) References Cited

FOREIGN PATENT DOCUMENTS

| | | | | | |
|---|---|---|---|---|---|
| CN | 112360407 | A | * | 2/2021 | |
| CN | 112610192 | A | | 4/2021 | |
| CN | 113586016 | A | * | 11/2021 | |
| CN | 113586016 | A | | 11/2021 | |
| CN | 113586016 | B | * | 12/2021 | |
| CN | 114183096 | A | * | 3/2022 | |
| CN | 114198066 | A | * | 3/2022 | |
| CN | 114542042 | A | * | 5/2022 | |
| CN | 114941517 | A | * | 8/2022 | |
| CN | 114809996 | B | * | 12/2022 | |
| WO | WO-0242604 | A1 | * | 5/2002 | ..... E21B 43/082 |

* cited by examiner

SAND CONTROL DEVICE FOR MARINE HYDRATE PRODUCTION

TECHNICAL FIELD

The present invention belongs to the technical field of hydrate production, and in particular, relates to a sand control device for marine hydrate production.

BACKGROUND

Natural gas hydrate is regarded as clean energy and has a broad application prospect, and the natural gas hydrate reserve is $2\times10^{16}$ $m^3$, which is twice the total amount of the existing fossil fuels. The natural gas hydrate is mainly reserved in the terrestrial permafrost and continental-marine sediments, and more than 90% of natural gas hydrate resources are distributed in the ocean. It can be seen from the field trial production that there are three main problems hindering the development of the natural gas hydrate, i.e., low productivity, sand production and poor economic benefits, wherein a large amount of sand production in the production process of the natural gas hydrate is the main cause of low productivity and poor economic benefits, and therefore, the key is to solve the problem of sand production in the natural gas hydrate production, which restricts the large-scale exploitation of the natural gas hydrate.

The occurrence state of marine hydrate in China is special in that the hydrate is mainly argillaceous silt hydrate reservoir, the formation sand has a small particle size far exceeding the operation limit of the current main sand control screen pipe and has poor sorting performance, and under the combined action of formation water and the water generated after the phase change, the formation sand can easily block the sand control screen pipe, resulting in production failure.

SUMMARY

In view of the above problems, the present invention is intended to provide a sand control device for marine hydrate production.

The technical solutions of the present invention are as follows.

A sand control device for marine hydrate production comprises an inner-layer sand control cylinder I and an outer-layer sand control screen arranged coaxially from inside to outside, and a motor I configured to drive the inner-layer sand control cylinder I to rotate, wherein a plurality of sand retaining balls are provided between the inner-layer sand control cylinder I and the outer-layer sand control screen.

Preferably, the inner-layer sand control cylinder I has the sand retaining mesh size less than or equal to that of the outer-layer sand control screen.

Preferably, the sand retaining ball has a diameter greater than the sand retaining mesh size of the outer-layer sand control screen.

Preferably, an inner surface of the outer-layer sand control screen is provided with a plurality of uniformly distributed radial steel rings I.

Preferably, an outer surface of the inner-layer sand control cylinder I is provided with a plurality of uniformly distributed radial steel rings II.

Preferably, the radial steel ring I and the radial steel ring II are distributed in a vertically staggered mode.

Preferably, the sand control device further comprises an inner-layer sand control cylinder II and a motor II, wherein the inner-layer sand control cylinder II and the inner-layer sand control cylinder I are arranged coaxially, the inner-layer sand control cylinder II has an outer diameter smaller than an inner diameter of the inner-layer sand control cylinder I, and a plurality of sand retaining balls are also provided between the inner-layer sand control cylinder II and the inner-layer sand control cylinder I, and wherein the motor II is configured to drive the inner-layer sand control cylinder II to rotate, and the rotating direction of the inner-layer sand control cylinder II is opposite to that of the inner-layer sand control cylinder I.

Preferably, the inner-layer sand control cylinder II has the sand retaining mesh size less than or equal to that of the inner-layer sand control cylinder I.

Preferably, an outer surface of the inner-layer sand control cylinder II is provided with a plurality of uniformly distributed radial steel rings III.

Preferably, when an outer surface of the inner-layer sand control cylinder I is provided with a plurality of uniformly distributed radial steel rings II, the radial steel ring III and the radial steel ring II are in the same horizontal plane.

The beneficial effects of the present invention are as follows.

According to the present invention, the sand retaining balls are provided between the inner-layer sand control cylinder I and the outer-layer sand control screen and are driven to rotate through the rotation of the inner-layer sand control cylinder I, so that the formation sand is prevented from being accumulated on the screen surface, and the screen is prevented from being blocked; large-particle formation sand is ground into small-particle-size formation sand which can pass through the sand control screen by the friction force and impact force generated in the rotation process of the sand retaining balls, so that the circulation efficiency of the sand control screen is improved; and the circulation channels formed between the sand retaining balls improve the circulation efficiency of the natural gas, and further block the formation sand from entering the wellbore, so that the sand control efficiency is improved.

BRIEF DESCRIPTION OF THE DRAWINGS

In order to more clearly illustrate the technical solutions in the embodiments of the present invention or in the prior art, the drawings required to be used in the description of the embodiments or the prior art will be briefly introduced below. It is apparent that the drawings in the description below are only some embodiments of the present invention, and for those of ordinary skill in the art, other drawings can be obtained according to these drawings without creative efforts.

Numerals of the drawings are described as follows: 1—inner-layer sand control cylinder I, 2—outer-layer sand control screen, 3—motor I, 4—sand retaining ball, 5—inner-layer sand control cylinder II, 6—motor II, 7—radial steel ring I, 8—radial steel ring II and 9—radial steel ring III.

DETAILED DESCRIPTION OF THE EMBODIMENTS

The present invention is further described below with reference to the following embodiments and drawings.

Figure 1:
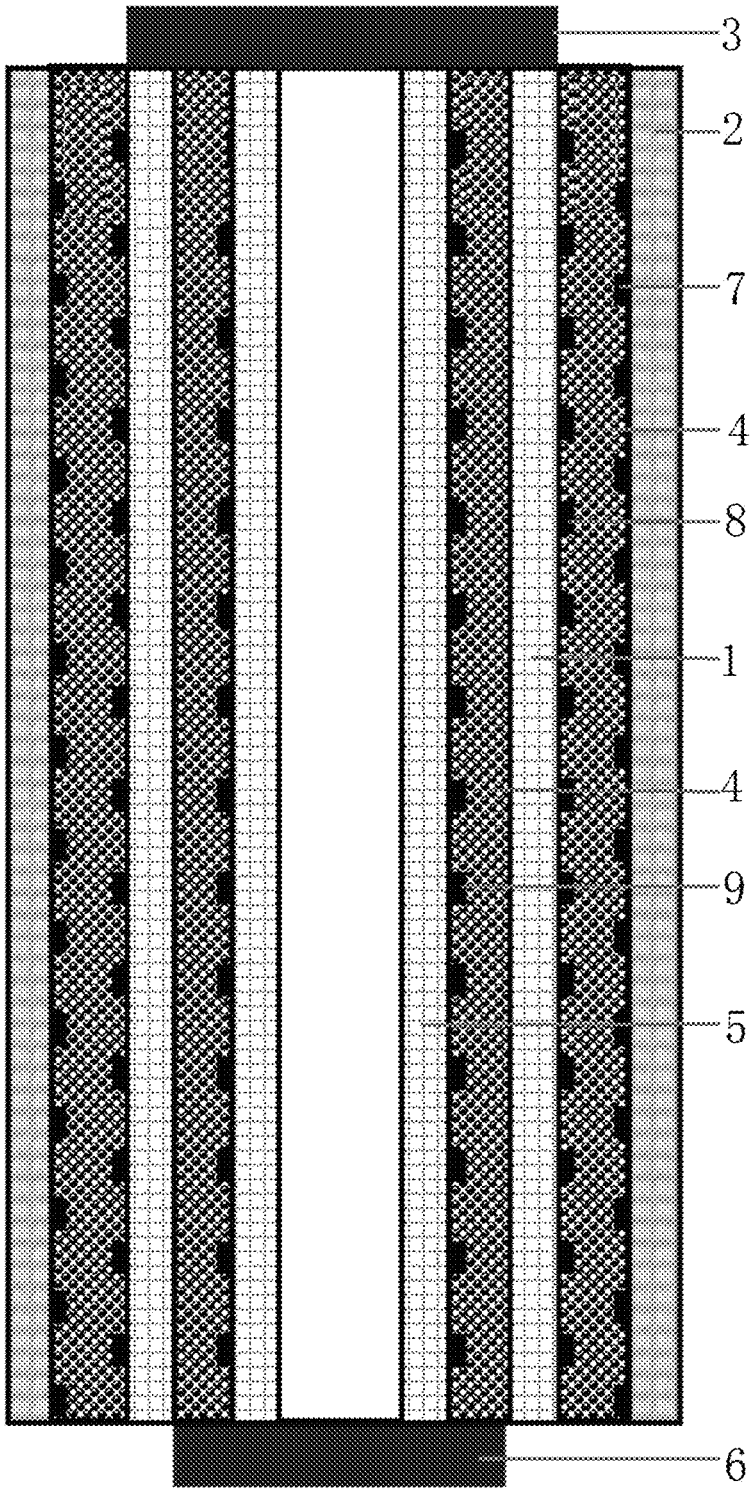
FIG. 1 is a front-view structural schematic diagram of a sand control device for marine hydrate production according to the present invention.
Figure 2:
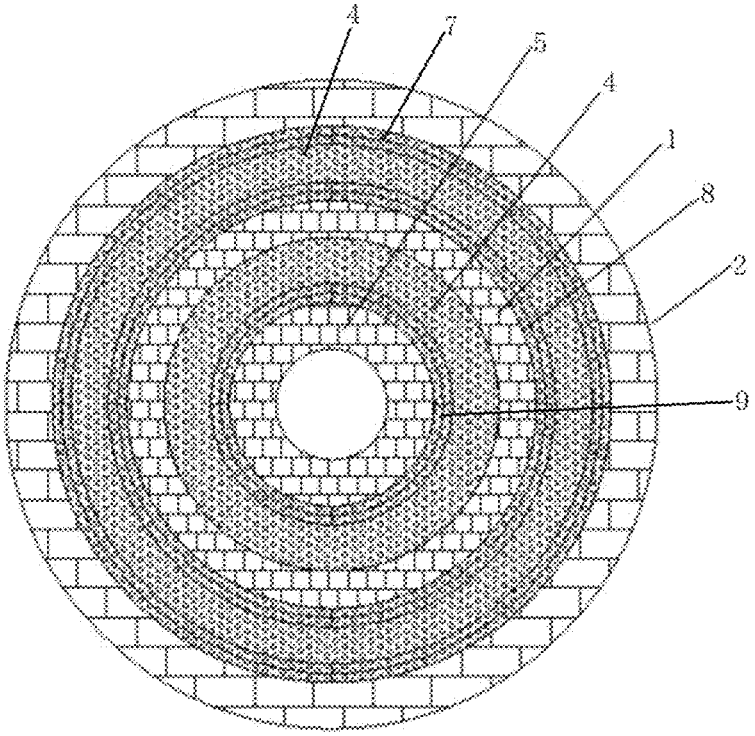
FIG. 2 is a top-view structural schematic diagram of a sand control device for marine hydrate production according to the present invention.

As shown in FIGS. 1-2, the present invention provides a sand control device for marine hydrate production, which comprises an inner-layer sand control cylinder I 1 and an outer-layer sand control screen 2 arranged coaxially from inside to outside, and a motor I 3 configured to drive the inner-layer sand control cylinder I 1 to rotate, wherein a plurality of sand retaining balls 4 are provided between the inner-layer sand control cylinder I 1 and the outer-layer sand control screen 2.

During the production process of the marine natural gas hydrate, the produced natural gas, water and formation sand flow to the sand control device from the formation, in the process of passing through the outer-layer sand control screen 2, the formation sand with the sand retaining mesh size larger than that of the outer-layer sand control screen 2 is isolated outside the screen, and the formation sand with the sand retaining mesh size smaller than that of the outer-layer sand control screen flows into the sand control device together with the natural gas and the water.

Under the driving of the motor I 3, the inner-layer sand control cylinder I 1 rotates to drive the sand retaining balls 4 between the inner-layer sand control cylinder I 1 and the outer-layer sand control screen 2 to rotate, then the formation sand with the sand retaining mesh size larger than that of the inner-layer sand control cylinder I 1 is isolated in the moving sand retaining balls 4 by the inner-layer sand control cylinder I 1, the constantly moving and colliding sand retaining balls 4 further grind the large-size formation sand, and after the size of the formation sand is smaller than that of the sand retaining mesh size of the inner-layer sand control cylinder I 1, the formation sand passes through the inner-layer sand control cylinder I 1 together with the natural gas and the water; and during this process, the constantly moving sand retaining balls 4 can also continue to clean up the formation sand between the inner-layer sand control cylinder 1 and the outer-layer sand control screen 2, so as to prevent the sand control cylinder from being blocked due to the accumulation of the formation sand on the outer surface of the inner-layer sand control cylinder 1.

In a specific embodiment, the sand control device further comprises an inner-layer sand control cylinder II 5 and a motor II 6, wherein the inner-layer sand control cylinder II 5 and the inner-layer sand control cylinder I 1 are arranged coaxially, the inner-layer sand control cylinder II 5 has an outer diameter smaller than an inner diameter of the inner-layer sand control cylinder I 1, and a plurality of sand retaining balls 4 are also provided between the inner-layer sand control cylinder II 5 and the inner-layer sand control cylinder I 1, and wherein the motor II 6 is configured to drive the inner-layer sand control cylinder II 5 to rotate, and the rotating direction of the inner-layer sand control cylinder II 5 is opposite to that of the inner-layer sand control cylinder I 1.

In this embodiment, under the driving of the motor II 6, the inner-layer sand control cylinder II 5 rotates in the direction opposite to the inner-layer sand control cylinder I 1, and the sand retaining balls 4 between the inner-layer sand control cylinder II 5 and the inner-layer sand control cylinder I 1 move more violently than the sand retaining balls 4 between the inner-layer sand control cylinder I 1 and the outer-layer sand control screen 2, so that the formation sand with a particle size larger than the sand retaining mesh size of the inner-layer sand control cylinder II 5 can be further ground, and the particle size of the inflowing formation sand is further reduced until the inflowing formation sand can pass through the inner-layer sand control cylinder II 5. The sand retaining balls 4 between the inner-layer sand control cylinder II 5 and the inner-layer sand control cylinder I 1 constantly move, which can effectively prevent the formation sand from accumulating on the outer surface of the inner-layer sand control cylinder II 5, avoiding the sand control failure. In this embodiment, the formation sand that can enter the wellbore already has a very small particle size, making it difficult to challenge the production safety of the marine hydrate.

In a specific embodiment, the inner-layer sand control cylinder I 1 has the sand retaining mesh size less than or equal to that of the outer-layer sand control screen 2, the inner-layer sand control cylinder II 5 has the sand retaining mesh size less than or equal to that of the inner-layer sand control cylinder I 1, and the sand retaining ball 4 has a diameter greater than the sand retaining mesh size of the outer-layer sand control screen 2.

Optionally, the outer-layer sand control screen 2 has the sand retaining mesh size of $(1.8-2.0)\times d_{50}$, wherein the $d_{50}$ is the median of the formation sand particle size; the inner-layer sand control cylinder I 1 has the sand retaining mesh size of $(1.5-1.8)\times d_{50}$; the inner-layer sand control cylinder II 5 has the sand retaining mesh size of $(1.2-1.5)\times d_{50}$; and both the sand retaining balls 4 between the inner-layer sand control cylinder II 5 and the inner-layer sand control cylinder I 1 and the sand retaining balls 4 between the inner-layer sand control cylinder I 1 and the outer-layer sand control screen 2 have a diameter of $(2.1-2.5)\times d_{50}$.

It should be noted that the sand retaining balls 4 between the inner-layer sand control cylinder II 5 and the inner-layer sand control cylinder I 1 and the sand retaining balls 4 between the inner-layer sand control cylinder I 1 and the outer-layer sand control screen 2 may have the same or different diameter. In a specific embodiment, the sand retaining ball 4 is a steel ball.

In a specific embodiment, an inner surface of the outer-layer sand control screen 2 is provided with a plurality of uniformly distributed radial steel rings I 7, an outer surface of the inner-layer sand control cylinder I 1 is provided with a plurality of uniformly distributed radial steel rings II 8, and an outer surface of the inner-layer sand control cylinder II 5 is provided with a plurality of uniformly distributed radial steel rings III 9.

Optionally, the radial steel ring I 7 and the radial steel ring II 8 are distributed in a vertically staggered mode, and the radial steel ring III 9 and the radial steel ring II 8 are in the same horizontal plane.

The radial steel ring I 7, on the one hand, can reinforce the outer-layer sand control screen 2 and resist formation pressure, thus prolonging the service life; and on the other hand, can make the inner surface of the outer-layer sand control screen 2 form an uneven surface, thus disturbing the movement track of the sand retaining balls 4 between the inner-layer sand control cylinder I 1 and the outer-layer sand control screen 2 and increasing the mutual collision of the sand blocking balls 4 during the movement.

The radial steel ring II 8, on the one hand, can reinforce the inner-layer sand control cylinder I 1 and resist high formation pressure and fluid pressure, thus prolonging the service life; and on the other hand, can make the outer surface of the inner-layer sand control cylinder I 1 form an uneven surface, thus disturbing the movement track of the sand retaining balls 4 between the inner-layer sand control cylinder I 1 and the outer-layer sand control screen 2 and increasing the mutual collision of the sand blocking balls 4 during the movement.

The radial steel ring III 9, on the one hand, can reinforce the inner-layer sand control cylinder II 5 and resist high formation pressure and fluid pressure, thus prolonging the service life; and on the other hand, can make the outer surface of the inner-layer sand control cylinder II 5 form an uneven surface, thus disturbing the movement track of the sand retaining balls 4 between the inner-layer sand control cylinder II 5 and the inner-layer sand control cylinder I 1 and increasing the mutual collision of the sand blocking balls 4 during the movement.

In conclusion, the sand control device of the present invention can improve the sand control efficiency by utilizing the sand retaining balls, the double sand control cylinders rotating reversely, the radial steel rings and the like, and compared with the prior art, the sand control device has significant progress.

The above descriptions are only preferred embodiments of the present invention, and are not intended to limit the present invention in any form. Although the preferred embodiments above have disclosed the present invention, they are not intended to limit the present invention. Any of those familiar with the technical field, without departing from the scope of the technical solutions of the present invention, can use the technical content disclosed above to make various changes and modify the technical content as equivalent changes of the equivalent embodiments. However, any simple modifications, equivalent changes and modifications made to the above embodiments according to the technical spirit of the present invention without departing from the content of the technical solutions of the present invention shall fall within the scope of the technical solutions of the present invention.

What is claimed is:

1. A sand control device for marine hydrate production, comprising an inner-layer sand control cylinder I and an outer-layer sand control screen arranged coaxially from inside to outside, and a motor I configured to drive the inner-layer sand control cylinder I to rotate, wherein a plurality of sand retaining balls are provided between the inner-layer sand control cylinder I and the outer-layer sand control screen; and further comprising an inner-layer sand control cylinder II and a motor II, wherein the inner-layer sand control cylinder II and the inner-layer sand control cylinder I are arranged coaxially, the inner-layer sand control cylinder II has an outer diameter smaller than an inner diameter of the inner-layer sand control cylinder I, and a plurality of sand retaining balls are also provided between the inner-layer sand control cylinder II and the inner-layer sand control cylinder I, and wherein the motor II is configured to drive the inner-layer sand control cylinder II to rotate, and the rotating direction of the inner-layer sand control cylinder II is opposite to that of the inner-layer sand control cylinder I.

2. The sand control device for marine hydrate production according to claim 1, wherein the inner-layer sand control cylinder I has the sand retaining mesh size less than or equal to that of the outer-layer sand control screen.

3. The sand control device for marine hydrate production according to claim 1, wherein the sand retaining ball has a diameter greater than the sand retaining mesh size of the outer-layer sand control screen.

4. The sand control device for marine hydrate production according to claim 1, wherein an inner surface of the outer-layer sand control screen is provided with a plurality of uniformly distributed radial steel rings I.

5. The sand control device for marine hydrate production according to claim 4, wherein an outer surface of the inner-layer sand control cylinder I is provided with a plurality of uniformly distributed radial steel rings II.

6. The sand control device for marine hydrate production according to claim 5, wherein the radial steel ring I and the radial steel ring II are distributed in a vertically staggered mode.

7. The sand control device for marine hydrate production according to claim 1, wherein the inner-layer sand control cylinder II has the sand retaining mesh size less than or equal to that of the inner-layer sand control cylinder I.

8. The sand control device for marine hydrate production according to claim 1, wherein an outer surface of the inner-layer sand control cylinder II is provided with a plurality of uniformly distributed radial steel rings III.

9. The sand control device for marine hydrate production according to claim 8, wherein when an outer surface of the inner-layer sand control cylinder I is provided with a plurality of uniformly distributed radial steel rings II, the radial steel ring III and the radial steel ring II are in the same horizontal plane.

* * * * *